United States Patent [19]

Matsubara et al.

[11] 4,287,697

[45] Sep. 8, 1981

[54] WALL PANEL ATTACHMENT APPARATUS

[75] Inventors: Isamu Matsubara, Nyuzen; Moriyoshi Hayashi, Kurobe, both of Japan

[73] Assignee: Yoshida Kogyo K. K., Tokyo, Japan

[21] Appl. No.: 96,310

[22] Filed: Nov. 21, 1979

Related U.S. Application Data

[63] Continuation of Ser. No. 859,469, Dec. 12, 1977, abandoned.

[30] Foreign Application Priority Data

Dec. 14, 1976 [JP] Japan ..... 51-168068

[51] Int. Cl.[3] ..... E04B 1/62

[52] U.S. Cl. ..... 52/403; 52/241; 52/364; 52/464; 52/773

[58] Field of Search ..... 52/36, 243, 238, 403, 52/463, 464, 484, 395, 585, 39, 241, 397, 483, 461, 364, 773

[56] References Cited

U.S. PATENT DOCUMENTS

| | | | |
|---|---|---|---|
| 2,280,094 | 4/1942 | Madsen | 52/464 |
| 3,052,330 | 9/1962 | Hammitt et al. | 52/464 X |
| 3,205,630 | 9/1965 | Felix et al. | 52/464 X |
| 3,509,674 | 5/1970 | Birum | 52/464 X |
| 3,530,633 | 9/1970 | Scott | 52/464 X |
| 3,830,029 | 8/1974 | Vance | 52/464 X |
| 3,844,086 | 10/1974 | Radtke | 52/464 X |
| 4,018,020 | 4/1977 | Sauer et al. | 52/464 X |
| 4,163,350 | 8/1979 | Doguchi et al. | 52/403 |

FOREIGN PATENT DOCUMENTS

| | | | |
|---|---|---|---|
| 799148 | 11/1968 | Canada | 52/484 |
| 2754087 | 6/1978 | Fed. Rep. of Germany | 52/484 |

*Primary Examiner*—J. Karl Bell

*Attorney, Agent, or Firm*—Hill, Van Santen, Steadman, Chiara & Simpson

[57] ABSTRACT

The present invention relates to a wall panel attachment apparatus for use in constructing a partition wall. This wall panel attachment apparatus comprises a pillar, a grooved wall panel, and a fitting fixture or the like. This pillar includes a panel-receiving flange projected from the top end of a plate-like portion of the pillar in the lateral direction and a joint-inserting portion having a screw-inserting groove, which is projected from the central portion of the panel-receiving flange. In this wall panel attachment apparatus, the wall panel having a groove formed on the side face thereof is disposed along the panel-receiving flange, a part of the fitting fixture is inserted in the groove of the wall panel and a screw is pressed in the above-mentioned screw-inserting groove to complete assembling.

2 Claims, 8 Drawing Figures

WALL PANEL ATTACHMENT APPARATUS

This is a continuation of application Ser. No. 859,469, filed Dec. 12, 1977, now abandoned.

BACKGROUND OF THE INVENTION

The present invention relates to a wall panel attachment apparatus for use in constructing a partition wall or the like.

In most of partitioning structures in offices and the like, wall panels are fitted in pillars having a special sectional profile, which are erected or supported between ceilings and floors.

In such conventional wall attachment apparatus, the sectional profile of the pillar is ordinarily complicate and the manufacture thereof is not easy. Further, a fitting fixture for use in attaching a wall panel to such pillar is exposed to the outer surface of the wall to interfere with the appearance of the resulting structure.

Recently, in order to attain a sound-insulating effect and a high decorative effect, large wall members composed of a sound-insulating material and not permitting a pillar or the like to be exposed to the surface are desired as wall panels. However, these requirements are not sufficiently satisfied by any of the conventional wall panel attachment apparatuses. Still further, the conventional wall panel attachment apparatuses are defective in that fixation of wall panel to pillars is a troublesome operation requiring much time and labor.

OBJECTS OF THE INVENTION

The present invention is to eliminate the foregoing defects and disadvantages involved in the conventional wall panel attachment apparatuses.

It is therefore a primary object of the present invention to provide a wall panel attachment apparatus including a wall panel-attaching pillar having a simple sectional profile.

Another object of the present invention is to provide a wall panel attachment apparatus by which a wall panel can be attached to a pillar very easily.

Still another object of the present invention is to provide a wall panel attachment apparatus by which a large wall panel can be attached without exposure of a fitting fixture to the surface of the wall panel.

A further object of the present invention is to provide a wall panel attachment apparatus by which a wall panel having a high sound-insulating effect can be attached very easily and a good sound-insulating effect can be attained in the resulting structure.

BRIEF SUMMARY OF THE INVENTION

In accordance with the present invention, there is provided a wall panel attachment apparatus comprising a pillar including a joint-inserting portion having an outwardly opened, screw-inserting groove formed thereon and a panel-receiving flange projected from the base end of the joint-inserting portion rectangularly thereto, a wall panel having a concave groove formed on the side face thereof, and a fitting fixture, wherein the wall panel is disposed along the pillar, a part of the fitting fixture is fitted in the concave groove formed on the side face of the wall panel, and a screw is inserted through a hole of the fitting fixture and is pressed in said screw-inserting groove.

DETAILED DESCRIPTION OF PREFERRED EMBODIMENTS

The present invention will now be described in detail by reference to preferred embodiments illustrated in the accompanying drawings.

Figure 2:
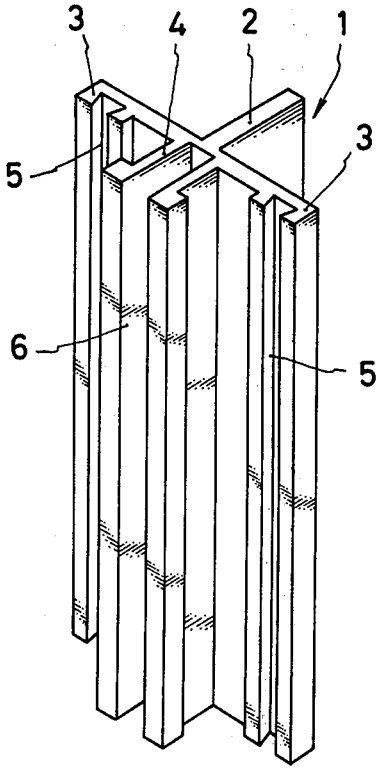
FIG. 2 is a perspective view, showing the main part of a pillar of the present invention.
Figure 3:
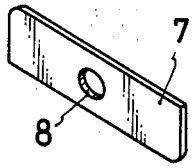
FIGS. 3 to 6 are perspective views, showing modifications of the fitting fixture that is used in the present invention.

A body 1 of the pillar in the wall panel attachment apparatus of the present invention has an I-shaped, T-shaped or cruciform section. The body 1 having a cruciform section is illustrated in FIG. 2. Panel-receiving flanges 3 are formed rectangularly to a plate-like portion 2 of the pillar body 1, and a joint-inserting portion 4 is formed on a front side extension line of the plate-like portion 2. An air-tight member inserting groove 5 is formed on the front face of each panel-receiving flange 3. The joint-inserting portion 4 consists of two walls and a screw-inserting groove 6 is formed between these two walls so that a screw fixing a fitting fixture can be inserted into this groove 6. The two walls define a reference edge leading to the groove 6. The width of the screw-inserting groove 6 is narrower than the major diameter of the screw but is substantially equal to the minor diameter of the screw. The pillar is prepared from aluminum or aluminum alloy by extrusion molding. Accordingly, when a screw is pressed and screwed into the screw-inserting groove 6, the screw is fixed as if the screw were screwed between female screws formed on both sides of the groove 6.

Figure 4:
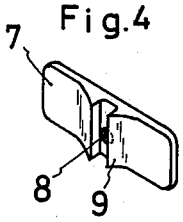
Figure 5:
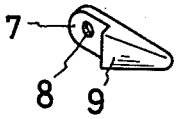
Figure 6:
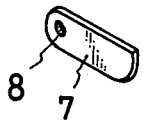

A fitting fixture 7 may have any of configurations shown in FIGS. 3 to 6. In the example shown in FIG. 3, a piercing screw-inserting hole 8 is formed in the interior of a strip-like metal plate, and in the example shown in FIG. 4, a pressing projection 9 is formed on one surface of the fitting fixture 7 and this projection 9 is located on the side of the screw-inserting groove 6 or on the end face of a wall panel 10 so as to prevent revolution of the fitting fixture 7 and separation of the fitting fixture from a groove 11 formed on the wall panel 10. In FIGS. 5 and 6, a portion to be inserted into the groove 11 of the wall panel 10 is formed on one side of the fitting fixture 7. In the example shown in FIG. 5, the thickness is inserted toward the screw-inserting hole 8. The groove 11 is formed in the central portion of the side face of the wall panel 10 so that the groove 11 extends in the lengthwise direction of the wall panel 10, and when a part of the fitting fixture 7 is inserted in this groove 11, the wall panel 10 is attached and fixed to the pillar 1.

Figure 7:
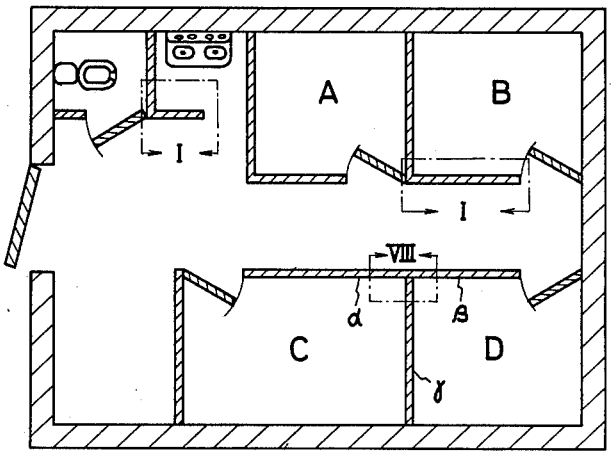
FIG. 7 is a plan view, diagrammatically showing a room partitioned by the wall panel attachment of the present invention.

FIG. 7 is a plan view, showing a room which is divided into zones A, B, C and D by the wall panel attachment apparatus of the present invention. The structure of the portion I in FIG. 7, which is illustrated in detail in FIG. 1 will now be described.

Figure 1:
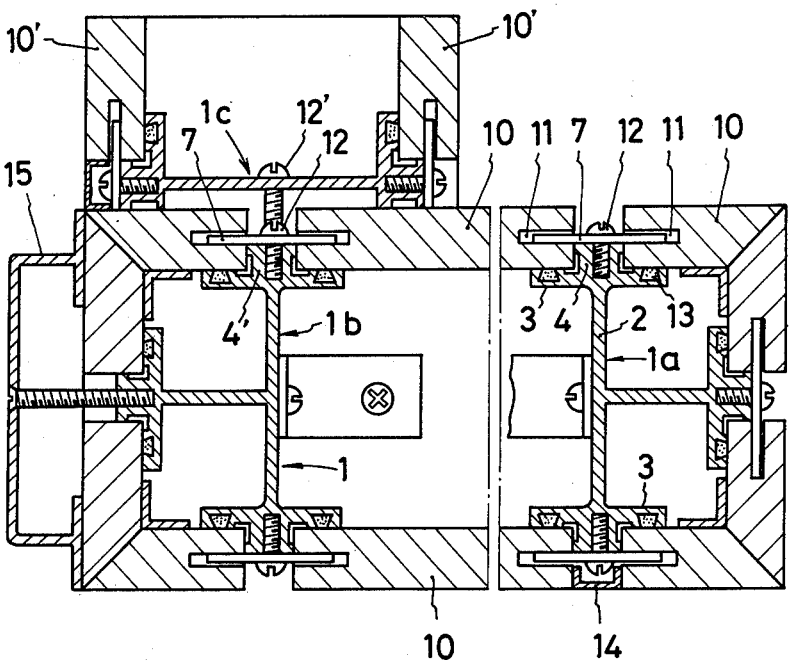
FIG. 1 is a cross-sectional view, showing the main part of a partition wall structure assembled by using the wall panel attachment apparatus of the present invention.

When a partition wall structure is constructed by utilizing the wall panel attachment apparatus of the present invention, pillars 1*a* and 1*b* are first erected at predetermined positions as shown in FIG. 1, and wall panels 10 are disposed along the panel-receiving flanges of the pillars 1*a* and 1*b*. Then, the top end of the fitting fixture 7 is fitted in the groove 11 on the side face of the panel 10, and a screw 12 is inserted into the hole 8 of the fitting fixture 7 and the top end of the screw 12 is pressed, screwed and fixed into the screw-inserting hole 6 so that the fitting fixure 7 presses against the reference edge defined by the two walls and panels 10 press against their respective flanges.

An air-tight member inserting groove 5 is formed on the surface of each panel-receiving flange 3, and an air-tight member 13 is inserted in this groove 5, whereby good air tightness can be maintained between the wall panel 10 and the panel-receiving flange 3.

For fixation of the fitting fixture 7 by pressing the screw 12 into the groove 6 formed on the joint-inserting portion 4, in addition to the above-mentioned method, there may be adopted a method in which the fitting fixture 7 is fitted in the groove 11 in advance or a method in which the fitting fixture 7 is fitted in the longitudinal direction in the joint between two wall panels 10 and the fitting fixture 7 is turned and fitted in the groove 11.

In examples shown in FIGS. 4 and 5, a projection 9 is formed on the fitting fixture 7, and this projection is fitted in the groove 11, whereby shaking of the attached wall panel 10 is effectively prevented.

When wall panels are constructed as shown in FIG. 1, a clearance is formed between the wall panels 10 in the joint-inserting portions 4. A joint filler 14 may be inserted in this clearance according to need.

When a wall panel 10' is attached rectangularly to the wall panel 10, a long screw 12' is pressed in the screw-inserting groove 6 of the joint-inserting portion 4' of the pillar 1*b* to fix a pillar 1*c* thereto, and the wall panels 10 and 10' are fixed to the pillar 1*c*.

FIG. 7 illustrates the state where the room is partitioned by fixing wall panels in the above-mentioned manner. Inlet and exit frames 15 and the like may be fixed by utilizing joint-inserting portions between two adjacent wall panels 10.

Figure 8:
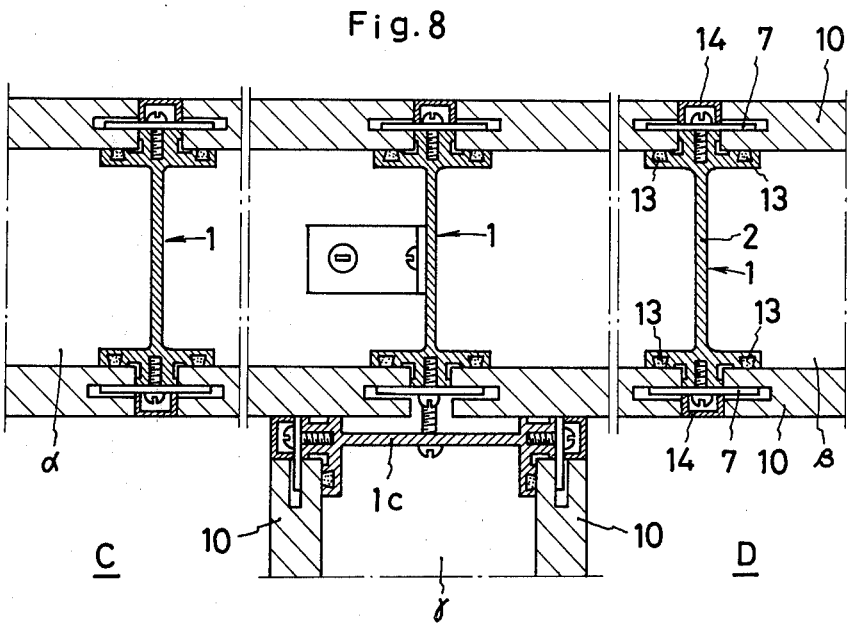
FIG. 8 is an enlarged view, illustrating the part VIII of FIG. 7.

FIG. 8 is an enlarged view, showing the part VIII in FIG. 7, and from FIG. 8, the state where partition walls $\alpha$, $\beta$ and $\gamma$ are assembled by the wall panel attachment apparatus of the present invention will readily be understood.

As will be apparent from the foregoing illustration, various partition walls can easily be assembled by utilizing the wall panel attachment apparatus of the present invention.

In the wall panel attachment apparatus of the present invention, the plate-like portion of the pillar is molded to have a T-shaped or cruciform section or a section of another shape, a panel-receiving flange is formed on the end portion of the plate-like portion rectangularly thereto, a projecting joint-inserting portion is formed on the front face of the panel-receiving flange, and a screw is pressed in a screw-inserting groove formed on the joint-inserting portion to thereby fix a fitting fixture or a pillar.

In the present invention, since the joint-inserting portion is formed in the central portion of the panel-receiving flange in the state projected therefrom, the wall panel can be fixed precisely at a predetermined position. Further, since the wall panel is fixed to the pillar by means of the fitting fixture and screw, the assembling operation can be remarkably facilitated. Especially, since a screw-inserting groove is formed in the joint-inserting portion to extend in the lengthwise direction thereof, the screw-fixing position may be set at any point in the lengthwise direction of the joint-inserting portion, namely in the lengthwise direction of the pillar. Still further, since a screw can be fixed only by pressing it into the screw-inserting groove, the assembling operation can be completed in a short time at a high speed.

The height of the joint-inserting portion is smaller than the thickness of the wall panel, and the fitting fixture is fixed in the state tightly fitted in the groove formed in the central portion of the side wall of the wall panel. Accordingly, the fitting fixture or screw is not exposed to the surface of the wall panel and a beautiful wall face can be constructed by using wall panels of a large size. In addition, it is feasible to dispose an air-tight member in an air-tight member inserting groove formed on the panel-receiving flange, and therefore a sound-insulating partition wall structure having good air tightness can be constructed.

Still in addition, since the pillar is prepared by extrusion molding of aluminum or aluminum alloy, it can be manufactured very easily without any trouble.

What is claimed is:

1. A wall panel attachment apparatus comprising an interior pillar, a plurality of wall panels, fitting fixture and screws, said pillar including a plate-like portion molded to have a cross section providing at least one flange transverse to said plate, each such panel-receiving flange formed at the edge of said plate-like portion, and a joint-inserting portion projected at a central portion of said panel-receiving flange in the direction of extension of the edge of the plate to a reference edge and having a screw-inserting groove in the reference edge extending in its longitudinal direction, said wall panels each having a groove formed in the side edge thereof and being disposed along said panel-receiving flange, said fitting fixture being fitted into said grooves of adjacent walls panels, said screw applied through the fitting being pressed into said screw-inserting groove to press the fixture against said reference edge and said panels against their respective flanges, whereby a partition wall structure is assembled around said pillar, another pillar with its plate portion transverse to the plate portion of said interior pillar positioned to cover said joint-inserting portion, at least one screw hole in said another pillar, and an extended length screw extending therethrough and into said groove formed in the joint-inserting portion, whereby another pillar is connected to said pillar and against said panels.

2. A wall panel apparatus as set forth in claim 1, wherein said interior pillar has a longitudinally extending web perpendicular to the plate portion and having a flange thereon generally perpendicularly to the remaining flanges whereby closure panels may be secured to enclose said interior pillar.

* * * * *